US007810800B2

(12) United States Patent
Schlicher

(10) Patent No.: US 7,810,800 B2
(45) Date of Patent: Oct. 12, 2010

(54) METHOD AND APPARATUS FOR DEPOSITING A FLEXIBLE MATERIAL WEB

(75) Inventor: Udo Schlicher, Enkenbach-Alsenborn (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 85 days.

(21) Appl. No.: 11/869,914

(22) Filed: Oct. 10, 2007

(65) Prior Publication Data

US 2008/0083804 A1 Apr. 10, 2008

Related U.S. Application Data

(63) Continuation of application No. PCT/DE2006/000522, filed on Mar. 24, 2006.

(30) Foreign Application Priority Data

Apr. 11, 2005 (DE) ..... 10 2005 016 745

(51) Int. Cl.
*B65H 29/46* (2006.01)

(52) U.S. Cl. ..... 270/30.01; 270/30.11; 270/30.13; 270/39.01; 270/39.05

(58) Field of Classification Search ..... 270/30.01, 270/30.11, 30.13, 39.01, 40, 39.05, 41; 226/7, 226/97.1
See application file for complete search history.

(56) References Cited

U.S. PATENT DOCUMENTS

| | | | | |
|---|---|---|---|---|
| 3,735,554 A | | 5/1973 | Maggio | |
| 4,181,052 A | * | 1/1980 | Kopp | 83/79 |
| 4,388,072 A | * | 6/1983 | Mueller et al. | 493/410 |
| 4,460,350 A | * | 7/1984 | Mittal et al. | 493/412 |
| 4,494,948 A | * | 1/1985 | Teyssier, Jr. | 493/11 |
| 4,516,760 A | | 5/1985 | Stumpf | |
| 4,622,028 A | * | 11/1986 | Bunch, Jr. | 493/413 |
| 4,708,331 A | * | 11/1987 | Etcheparre et al. | 270/30.11 |
| 4,958,819 A | | 9/1990 | Jung | |
| 5,062,597 A | * | 11/1991 | Martin et al. | 270/39.02 |
| 5,087,140 A | | 2/1992 | Keeton et al. | |

FOREIGN PATENT DOCUMENTS

| | | |
|---|---|---|
| DE | 31 45 026 A1 | 5/1983 |
| DE | 91 16 502 U1 | 12/1992 |
| DE | 196 44 383 C1 | 4/1998 |
| DE | 101 25 452 A1 | 12/2002 |
| JP | 60-44468 | 3/1985 |
| JP | 1-176785 | 7/1989 |

OTHER PUBLICATIONS

The International Search Report for PCT/DE2006/000522, completed Jun. 13, 2006.

* cited by examiner

*Primary Examiner*—Leslie A Nicholson, III
(74) *Attorney, Agent, or Firm*—Alston & Bird LLP

(57) ABSTRACT

The invention relates to a method and a device for depositing a flexible material web, said web being introduced into a folding unit and being deposited from said folding unit at a depositing point. The aim of the invention is to achieve higher production speeds with an excellent fold quality, even for material webs with a low weight. To achieve this, compressed air is applied to the material web after the latter has exited the folding unit in order to support the festooning process by means of a blower device.

8 Claims, 3 Drawing Sheets

Fig. 3
Fig. 3a)
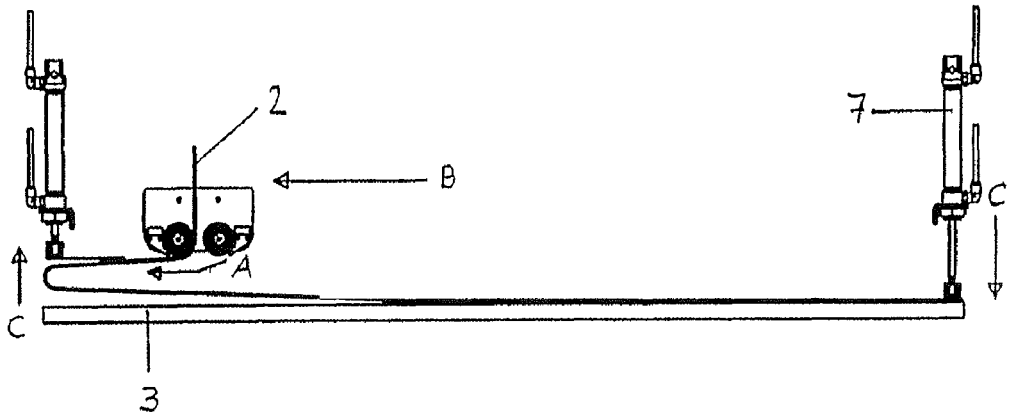
Fig. 3b)
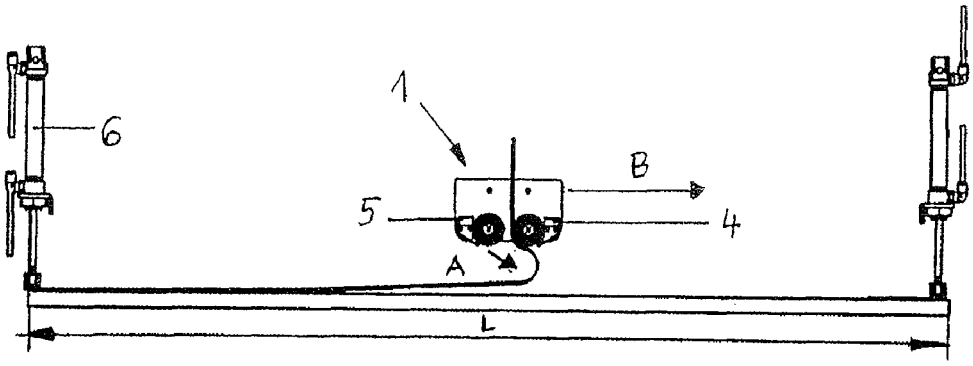
Fig. 3c)
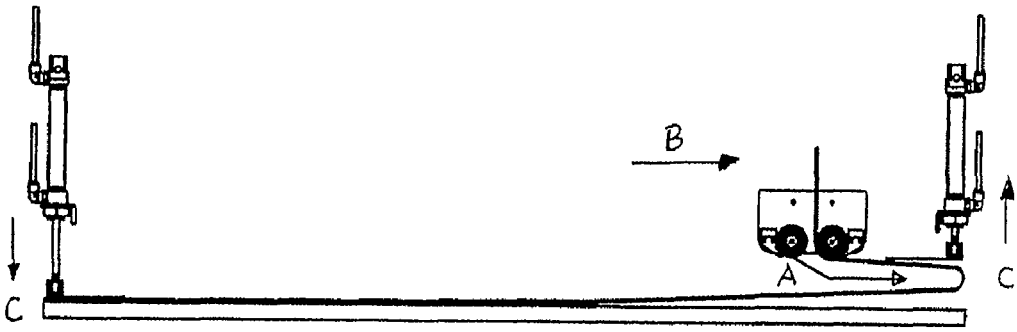

METHOD AND APPARATUS FOR DEPOSITING A FLEXIBLE MATERIAL WEB

CROSS-REFERENCE TO RELATED APPLICATIONS

The present application is a Continuation of International Application No. PCT/DE2006/000522, filed Mar. 24, 2006, and which designates the U.S. The disclosure of the referenced application is incorporated herein by reference.

FIELD OF THE INVENTION

The present invention relates to a method and an apparatus for depositing a flexible material web, wherein the material web is introduced into a folding unit, and is deposited from the folding unit at a depositing point. The material web is deposited particularly in a zigzag form over the depositing length of the depositing point.

BACKGROUND OF THE INVENTION

Flexible material webs are used in many sectors of industrial processing. The material webs can be in the form of textile sheet-like structures, such as woven fabrics, knitted fabrics and nonwovens, or in the form of paper products, natural products, plastic products or metal products, laminar bonding materials or composites made therefrom. Foamed and/or coated and/or fibrous products are also used as flexible material webs, which are processed further subsequently.

Since material webs are usually too narrow to be wound on rollers, the material web is deposited in a zigzag form in receiving containers or at depositing points such as platforms or the like in several layers, wherein substantially more running meters of material can be accommodated than if the material is wound up on rollers.

The method of the zigzag deposition of the material web has been disclosed, for example, in the U.S. Pat. No. 5,087,140 under the name "Festooning" and the associated apparatus has been disclosed under the name "Festooner". Here, the material web is deposited by means of a folding unit on a platform, which moves back and forth in transverse direction. The folding unit is formed by a laying arm, which is swiveled forwards and backwards in the longitudinal direction.

DE 196 44 383 C1 likewise discloses a swivel arm as a folding unit. The material web can be transported over the width of the swivel arm while the latter moves. Here, the material web is guided to the depositing point between conveyor belts circulating around rollers.

U.S. Pat. No. 3,735,554 discloses an apparatus for laying strip material, wherein the folding units disposed above cardboard boxes are arranged on a frame that can be displaced longitudinally. The folding units merely comprise two rollers. The material exiting between the rollers of the folding unit moves freely and in an unguided manner in the space above the cardboard boxes. This movement of the material is disadvantageous with respect to achieving a precise deposition of the material.

Additional types of folding units relate to rollers, as disclosed in DE 101 25 452 C2 and DE 91 16 502 U1. The laying rollers described in these patent specifications are components of a laying carriage, which can be displaced in reversible orientation. The material web is transported between the laying rollers to the depositing point. The material web is displaced together with the laying rollers or the carriage over a defined depositing length, which corresponds, for example, to the width of a pallet.

Although all these folding units disclosed in the prior art are naturally functional, problems occur when the wind caused by the movement of the material web and/or the folding unit interferes with the depositing method, particularly in the case of material webs having a low weight. In precise terms, it is possible that the material web does not reach the edge of the depositing point and is then not grasped by a hold-down device or a gripper. While on the one hand, the space at the depositing point is not used in an optimum manner, there can be a formation of wrinkles on the other hand and thus an impaired depositing behavior and depositing pattern. Another disadvantage is that the speed of the movements has to be relatively low so as to be able to deposit particularly material webs having a low weight. The higher the speed of the material web and/or the folding unit, the stronger is the air turbulence, which in turn results in position inaccuracies of the material web. The air influences are manifold and different in nature.

The disadvantageous process of depositing the material web will become particularly clear using the example of a swivel arm at the time of the change in orientation. The material web exits from the swivel arm and while it moves downwards towards the depositing point, the swivel arm swivels and causes an air resistance to a certain extent, wherein the depositing process in the boundary region of the depositing point is interrupted and the material web section intended to remain there is restrained increasingly in direct proportion to the lightness of the material web and can no longer be grasped by a hold-down device or a gripper. The process described for a swivel arm also basically applies to a laying carriage having laying rollers.

Another difficulty is with respect to the electrostatic effects, which exist on the one hand between the conveyor belt of the swivel arm and the material web, and on the other hand between the hold-down device and the material web mostly due to the plastic portions in the material. On the one hand, the exiting material web is gravitated towards the conveyor belt; while on the other hand, the already deposited material web is gravitated towards the hold-down device. Particularly lightweight material webs are subject to the forces of attraction. This results in problems during the deposition of the material web. Similar effects are also known to occur when depositing the material web using laying rollers.

The apparatuses disclosed in the prior art for depositing a flexible material web are thus capable of subsequent improvement, particularly with respect to the deposition of a material web having low weight and at high speed.

Based on the prior art, it is the object of the present invention to specify a method and an apparatus of the kind in question, wherein higher production speeds are achieved with good fold quality even in the case of material webs having a low weight.

SUMMARY OF THE INVENTION

The afore-mentioned object is achieved with respect to the inventive method by the features set forth in claim 1. Accordingly, a method of the type in question is developed and further improved in such a way that, compressed air is applied to the material web after its exit from the folding unit in order to support the depositing method.

It was first realized in accordance with the invention that higher production speeds can be achieved with good fold quality even in the case of material webs having a low weight if air turbulence and electrostatic effects are counteracted. It has further been realized that it is possible to counteract the air turbulence caused by the courses of movement of the material web and the folding units, and the electrostatic effects if compressed air is applied to the material web in a targeted manner. It is possible to work against the air turbulence and electrostatic effects using compressed air, for example, when the change in the orientation of the folding unit takes place and the latter begins to move in the opposite direction and the material web section intended for the boundary region of the depositing point is virtually "entrained". Another effect brought about by the compressed air is that the material web to be deposited overcomes the electrostatic force of attraction existing between the topmost layer of the already existing stack of material webs and the hold-down device. This prevents a wrong orientation of the deposited topmost layer of the material web.

The application of compressed air can be used to counteract the effect of an air resistance or even a pulling effect caused by air streams, and the electrostatic attraction not only at the critical point of the change in orientation, but also during the entire deposition over the depositing length. The material web exiting the folding unit could constantly be pressed using compressed air against its depositing place opposite to the direction of movement of the folding unit and be largely secured against displacement and the formation of wrinkles and ripples. The application of compressed air to the material web also helps overcome the force of attraction exerted by the folding unit or its means of transport.

In this way even material webs having low density of <50 g/m$^2$ and a width of 35 mm can be deposited at high speeds of over 150 m/min using a laying method or swivel arm method and at speeds exceeding far beyond 200 m/min using other laying methods. Likewise, material webs having a density of approx. 150 g/m$^2$ and a width of 70 mm can be deposited at high speeds of approx. 200 m/min using laying methods or swivel arm methods or at a speed of 300 m/min using other laying methods. In any case, the folding units that have been disclosed in the prior art and have been described in the introduction cannot be used to achieve these speeds.

The material web is continuously delivered subsequently during the depositing method and moved towards the depositing point or the stack of material webs. In order to achieve the desired effect with compressed air, the compressed air is expediently directed in such a way that it hits that side of the material web, which is intended to form the upper side of the topmost layer of the stack of material webs. For this purpose it is necessary to direct the compressed air approximately in the direction of movement of the material web and/or of the folding unit. Since compressed air is supposed to hit the upper side of the material web, the compressed air is not directed completely parallel to the direction of movement of the folding unit or of the material web, but is angled downwardly till it hits the material web.

The application of compressed air is particularly advantageous when the material web is in the reversal point during the zigzag deposition. Then the compressed air brings about a supporting effect by assisting the material web in arriving into the region of a hold-down device, in order to be fixed there temporarily, if necessary.

Corresponding to the zigzag depositing method, the application of compressed air could take place alternately according to the change in the orientation of the material web and/or of the folding unit. For this purpose, two opposite blower devices could be provided, each of which operates in the opposite direction. The lighter and/or the narrower the material web, the earlier can compressed air be applied to the material web using the blower device. The earliest possible time for the application of the compressed air by one blower device is when the change in orientation of the material web has taken place and the application of compressed air by the opposite blower device has ended. In this case, a continuous alternating application of compressed air would be present.

The heavier and/or broader the material web, the more delayed is the start of the blowing process. For example, the application of compressed air by one blower device and the change in orientation of the material web could already be concluded when the application of compressed air in the opposite direction takes place. In this case, a discontinuous, alternating application of compressed air would be present. The more problematic the material, the more continuous is the application of compressed air. Thus the application of compressed air does not depend on the apparatus, but on the material.

Furthermore, the object of the present invention is an apparatus, which achieves the underlying object by means of the features set forth in claim 8. Accordingly, an apparatus for depositing a flexible material web using a folding unit for supplying the material web to at least one depositing point is improved further according to the invention by providing the folding unit with at least one blower device, which applies compressed air to the exiting material web in order to support the depositing method.

Just as in the case of the inventive method, it has also been realized with respect to the apparatus of the invention that a targeted application of compressed air to the material web can counteract air influences, which result from the movement of the material web itself or from the movement of the folding unit, thereby achieving a precise deposition at high speeds even in the case of material webs having a low weight.

Depending on the type of the folding unit—viz. swivel arm or laying carriage or laying rollers—the material web is conveyed to the depositing point between means of transport, designed in the form of rollers or belts. A direct contact with the means of transport of the folding unit concludes at the end of the depositing length or when the material web has reached the exit point for the material web.

Alternatively, the apparatus of the invention could also be used in connection with a folding unit, wherein the material web is transported to the depositing point by means of suction devices spaced apart from each other or air chambers, and the material web swivels freely to some extent between the latter. The means of transport here can likewise be present as a circulating belt, which seals the air chamber and the material web is sucked in simultaneously by way of the perforation of the belt.

A blower device can be assigned to each of these different means of transport, which are mostly present in pairs. In order to prevent an interference in the transport of the material web, the blower devices could each be disposed at a short distance from that outer circumference of the means of transport that points away from the material web. The alternating movement of the material web requires two blower devices having nozzle outlets, which are disposed opposite to each other. The nozzle outlets could open into a region located below the means of transport—precisely into the region of the exit point of the material web in order to enable a direct action. Furthermore, the nozzle outlets could be expediently oriented towards the material web since the air jet is supposed to hit the material web.

The blower devices could be controlled by a controller such as a PLC (Programmable Logic Controller) and pressurized with compressed air in a targeted manner. The application of compressed air by one blower device could take place when a change in orientation has taken place during the depositing process and the application of compressed air by the other blower device has ended. However, here also a discontinuous application of compressed air to the material web is conceivable depending on the properties of the material web. It is essential for the upper side of the deposited material web to be kept tight and smooth by the application of compressed air and for the "overfeeding" of the material web to take place in the boundary region of the depositing point, so that the material web arrives below the hold-down device or into the gripper and in doing so also overcomes electrostatic forces of attraction between the hold-down device and the previous topmost layer of the stack of material webs as well as the air resistance caused by the courses of movement.

It would not only be possible for the blower devices to apply compressed air alternately and in a controlled manner, but also to adjust the nozzle outlets or the respective air stream to the respective width of the material web and/or its physical properties, such as weight, surface finish etc.

According to a preferred variant, the width of the nozzle outlet corresponds to the width of the means of transport of the folding unit. Thus all the widths of the material web are covered. If a material web having a narrow width is being laid, the nozzle outlet or the air stream can be adjusted to it. For adjusting the air stream, the interior of the blower devices could be provided with mechanical slides or the like, which change the cross-section of flow. In principle, the nozzle outlet could also be smaller than the width of the material web, although this could somewhat reduce the effect.

As regards additional advantageous forms of the apparatus of the invention, reference should be made to the general description of the method of the invention particularly since the features that are also relevant to the apparatus have been explained there.

BRIEF DESCRIPTION OF THE DRAWINGS

The inventive method will be described in more detail hereinbelow with the aid of an exemplary embodiment of the inventive apparatus, with reference to the accompanying drawings.

FIG. 3 shows purely schematic, greatly simplified, basic sketches of the operational sequence during the alternating, discontinuous application of compressed air to the material web with respect to the objects shown in FIGS. 1 and 2, in the final phase of the application of compressed air in the end position of the folding unit on one side of the depositing point (FIG. 3*a*), start of the application of compressed air in the opposite direction (FIG. 3*b*), and final phase of the application of compressed air in the end position of the folding unit on the opposite side of the depositing point (FIG. 3*c*).

DETAILED DESCRIPTION OF PREFERRED EMBODIMENTS

Figure 1:
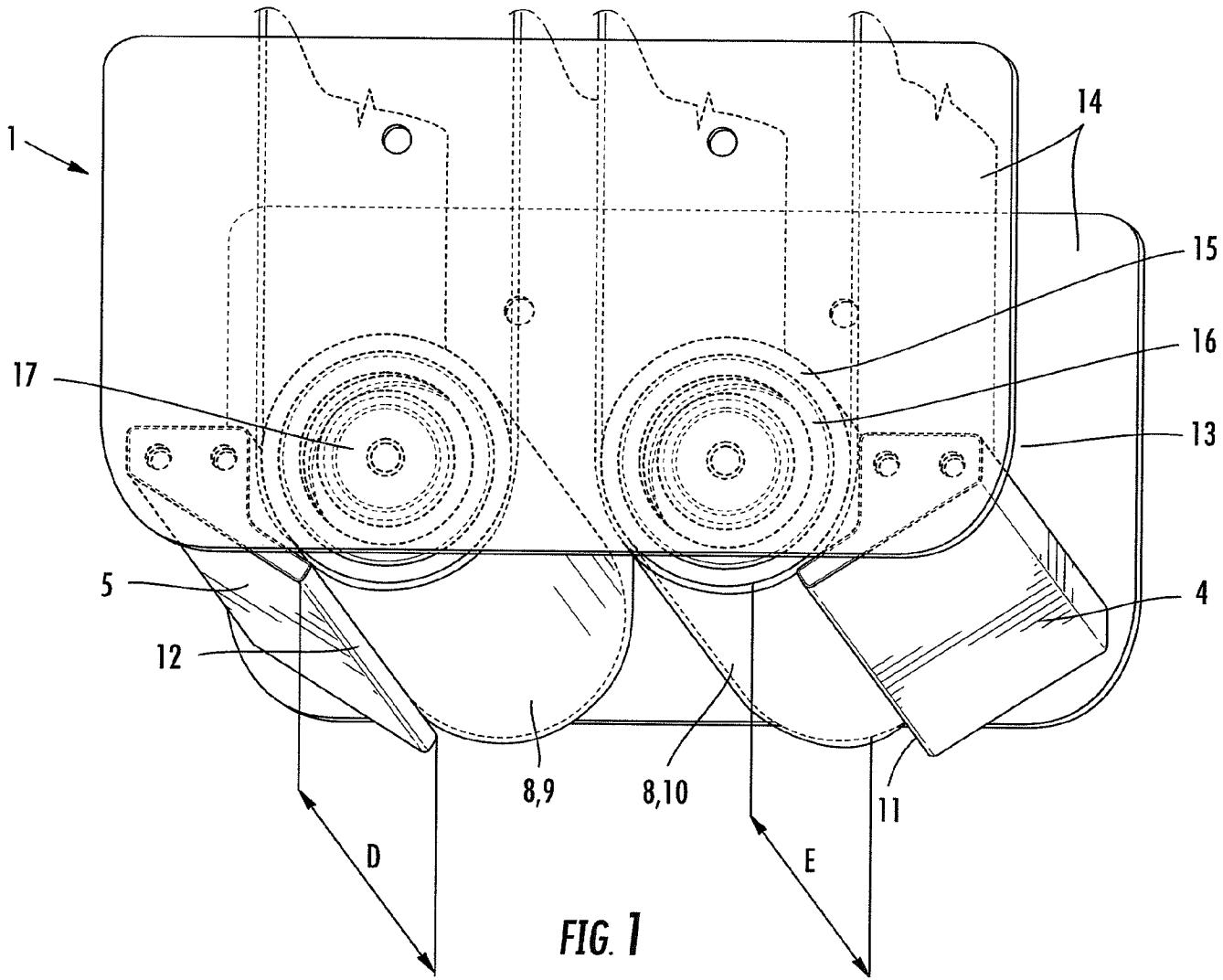
FIG. 1 is a schematic, perspective representation of an exemplary embodiment of the apparatus of the invention.

FIG. 3 schematically shows the apparatus of the invention for depositing a flexible material web, which apparatus is suitable for implementing the method of the invention and comprises a folding unit 1 for supplying the material web 2 to a depositing point 3.

According to the invention, compressed air is applied to the material web 2 after the latter has exited from the folding unit 1 by means of two blower devices 4, 5 disposed opposite to each other in order to support the depositing method.

FIG. 3*b* and also FIGS. 3*a* and 3*c* show that the compressed air hits that side of the material web 2, which is supposed to form the topmost layer of a future, still inexistent stack of material webs, as shown by the arrows A indicating the blowing direction. This helps achieve a smoothing and tensioning of the surface.

Hold-down devices 6, 7 are provided at the ends of the depositing point 3 in the present exemplary embodiment. FIGS. 3*a* and 3*c* clearly show that compressed air contributes to the arrival of the material web 2, due to overfeed, into the region of the respective hold-down device 6, 7 in order to be fixed there temporarily. In order for the hold-down devices 6, 7 to grasp the material web 2, the compressed air blows the material web 2 towards those locations that cannot be reached by the folding unit 1, designed as a laying carriage, since it has reached its respective end position due to structural reasons.

The compressed air is aligned constantly and substantially in the direction of movement B of the folding unit 1 of the material web 2 and towards its upper side, as shown by the arrows A.

It follows clearly from FIGS. 1 and 3 that there are provided two opposite blower devices 4, 5. Depending on the orientation of the direction of movement B of the folding unit, these blower devices 4, 5 operate in the corresponding blowing direction A.

In the present exemplary embodiment, the application of compressed air by the blower device 5 starts approximately in the center of the depositing length L of the depositing point 3, as shown in FIG. 3*b*. The direction of movement B towards the hold-down device 7 corresponds approximately to the blowing direction A, which is additionally oriented slightly downwards in relation to the upper side of the material web 2. The hold-down devices 6, 7 are both in the hold position.

As the folding unit increasingly approaches the hold-down device 7, the latter moves upward in the direction of movement C. When the folding unit 1 has arrived in its final position, as shown in FIG. 3*c*, the process of "overfeed" or "belly formation" of the material web 2 takes place, which process is supported by applying compressed air in the blowing direction A.

The same procedure takes place on the return depositing path towards the hold-down device 6, although in reverse orientation. While the hold-down device 6 is in the open position in FIG. 3*a*, the hold-down device 7 is in the hold position. The blower device 5 has stopped the application of compressed air before the change in orientation, and blower device 4 starts with the blowing process, when the folding unit 1 is located approximately in the center of the depositing length L of the depositing point 3. Here, the quality of the material web 2 does not require compressed air to be applied continuously.

The folding unit 1 shown in FIGS. 1 and 3 comprises means of transport 8 in the form of rollers 9, 10, around which the conveyor belts circulate. The distance of the rollers of 9, 10 from each other can be adjusted according to the thickness of the conveyor belts and thickness of the material web 2.

Figure 2:
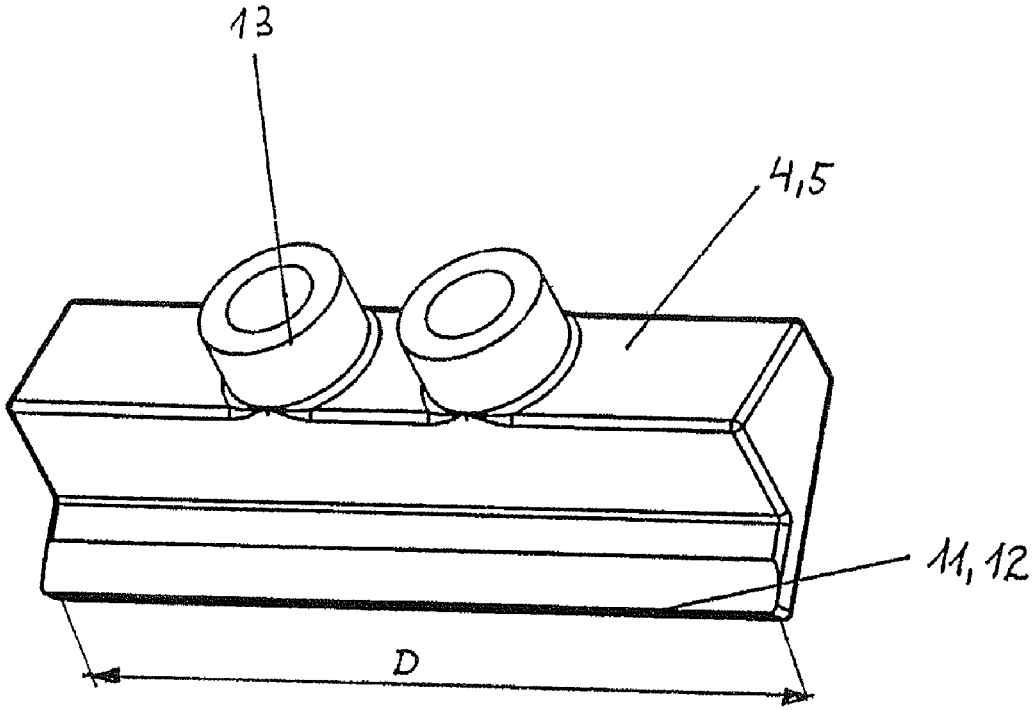
FIG. 2 is a schematic perspective reduced representation of a detail of the object shown in FIG. 1.

Blower devices 4, 5 are each assigned to rollers 9, 10 at a small distance from that outer circumference of the roller that points away from the material web 2. The nozzle outlets 11, 12 of the blower devices 4, 5 respectively shown in FIGS. 1 and 2, are disposed opposite to each other, and they each open into a region located below the rollers 9, 10 in the blowing direction A so that compressed air can hit the upper side of the material web 2 to be deposited.

The blower devices 4, 5 can be controlled by a controller such as a PLC (Programmable Logic Controller) and pressurized with compressed air in a targeted manner. Connections 13 are provided for compressed-air lines.

The reference numeral 14 in FIG. 1 indicates two holding plates, between which the rollers 9, 10 and the blower devices 4, 5 are disposed and to which the latter are also fixed. The rollers and the blower devices are fixed to the holding plates by means of screw connections through openings (not shown in detail). The rollers 9, 10 consist of an aluminum pipe 15, a ball bearing 16 and a shaft 17 with front-sided holes for being fixed to the holding plate 14. The folding unit shown here can be used both as a laying carriage, as shown in FIG. 3, and also a swivel arm.

The width D of the nozzle outlet 11, 12 corresponds to the width E of the means of transport 8, 9, 10 of the folding unit 1 in the present exemplary embodiment, wherein the compressed air can be adjusted to the width of the material web 1 in a targeted manner.

With regard to additional features not shown in the figures, reference should be made to the general part of the description.

In conclusion, it should be pointed out that the teaching according to the present invention is not restricted to the exemplary embodiment described above. Rather, an extremely wide range of different embodiments of the blower devices, folding units, transport mechanism, and also different forms of nozzle outlets and control concepts are possible.

That which is claimed is:

1. A method for depositing a flexible material web, said method comprising:

introducing a material web into a folding unit;

depositing the material web from the folding unit at a depositing point in a zigzag manner; and applying compressed air to the material web after the material web has exited from the folding unit in order to support the depositing process, wherein a blower device for supplying the compressed air is arranged with respect to the folding unit in the region of the exiting material web and moves with the folding unit and wherein the blower device has nozzle outlets which open into a region located below the folding unit and are oriented towards the exiting material web.

2. The method according to claim 1, wherein said applying compressed air comprises applying compressed air that hits an upper side of the material web, that forms the topmost layer of a stack of material webs.

3. The method according to claim 1, wherein said applying compressed air comprises applying compressed air that contributes to the arrival of the material web into a region of a hold-down device in order to be fixed there temporarily.

4. The method according claim 1, wherein the application of compressed air alternates correspondingly to the change in orientation of the material web or of the folding unit.

5. The method according to claim 1, wherein directing the compressed air comprises orienting the compressed air according to an approximate direction of movement of the material web or of the folding unit.

6. The method according to claim 1, further comprising operating two opposite blower devices, each of which operates in an opposite direction, and wherein said applying compressed air comprises applying compressed air to the material web using one blower device no earlier than when a change in the orientation of the material web or of the folding unit has taken place and the application of compressed air to the material web by the opposite blower device has ended.

7. The method according to claim 6, further comprising starting one blower device in a repeat application of compressed air to the material web in the opposite direction in a time-shifted manner at the end of the application of compressed air by the opposite blower device.

8. A method for depositing a flexible material web, said method comprising:

introducing a material web into a folding unit;

depositing the material web from the folding unit at a depositing point in a zigzag manner; and applying compressed air to the material web after the material web has exited from the folding unit in order to support the depositing process, wherein a blower device for supplying the compressed air is arranged to the folding unit in the region of the exiting material web and moves with the folding unit, wherein the blower device has nozzle outlets which open into a region located below the folding unit and are orientated towards the exiting material web, wherein a pair of blower devices disposed opposite to each other is provided, and wherein the application of compressed air by a blower device to the material web takes place when a change in the orientation of the material web and the folding unit has taken place and the application of compressed air by the opposite blower device has ended.

* * * * *